United States Patent [19]

Ingebrigtsen et al.

[11] 4,101,965

[45] Jul. 18, 1978

[54] SURFACE ACOUSTIC WAVE DEVICES FOR PROCESSING AND STORING SIGNALS

[75] Inventors: Kjell A. Ingebrigtsen, Trondheim, Norway; Abraham Bers, Arlington; John H. Cafarella, Swampscott, both of Mass.

[73] Assignee: Massachusetts Institute of Technology, Cambridge, Mass.

[21] Appl. No.: 690,601

[22] Filed: May 27, 1976

[51] Int. Cl.[2] ..... G06G 7/19; H04R 17/00

[52] U.S. Cl. ..... 364/821; 310/313; 310/366; 333/30 R; 333/72; 357/51; 364/861; 365/175

[58] Field of Search ..... 235/181; 340/173 R; 340/173 MS; 333/30 R; 333/72; 357/51; 357/23; 364/821; 364/861

[56] References Cited

U.S. PATENT DOCUMENTS

| | | | |
|---|---|---|---|
| 3,833,867 | 9/1974 | Solie | 235/181 |
| 3,886,503 | 5/1975 | Bert et al. | 333/30 R |
| 3,886,527 | 5/1975 | Bert et al. | 340/173 MS |
| 3,886,529 | 5/1975 | Bert et al. | 333/30 R |
| 3,909,119 | 9/1975 | Wolley | 357/51 |
| 3,935,564 | 1/1976 | Quate et al. | 340/173 R |
| 3,953,836 | 4/1976 | Kantorowicz | 340/173 MX |
| 3,975,696 | 8/1976 | Kantorowicz | 235/181 |
| 3,990,099 | 11/1976 | Duigon et al. | 357/51 |
| 4,016,412 | 4/1977 | Stern et al. | 235/181 |
| 4,031,490 | 6/1977 | Copeland | 235/181 |

OTHER PUBLICATIONS

Maerfeld et al.; Acoustic Shorage and Processing Device Using p-n Diodes, Appl. Physics Letters, vol. 27, No. 11, Dec. 1, 1975, pp. 577/578.

Ingebrigtseer et al., A Schottky-Diode Acoustic Memory and Correlator, Appl. Physics Letters, vol. 26, No. 11, June 1, 1975, pp. 596/598.

Bers et al.; Surface State Memory in Surface Acoustielectric Correlator, Appl. Physics Lettters, vol. 25, No. 3, Aug. 1, 1974, pp. 133/135.

Hayakawa et al.; Storage of Acoustic Signals in Surface States in Silicon, Appl. Ph. Letters, vol. 25, No. 4, Aug. 14, 1974, pp. 178/180.

Bert et al.; Signal Processing by Electron-Beam Interaction with Pieqoelectric Surface Waves, IEEE Transactions in Sonics and Ultrasonics, Apr. 1973, pp. 173-181.

Stern et al.; New Adaptive Signal Processing Concept, Electronics Letters, vol. 10, No. 5, Mar. 7, 1974, pp. 58/59.

Joly,; Design of a Convolver for Optical Imaging, G. L. Report 2560, Stanford University Laboratories of Physics, Abstract and pp. 128-130 of interest.

*Primary Examiner*—Felix D. Gruber

*Attorney, Agent, or Firm*—Robert F. O'Connell

[57] ABSTRACT

A surface acoustic wave device utilizing a piezoelectric substrate capable of propagating traveling acoustic waves along a surface thereof and a semiconductive substrate positioned adjacent such surface, the latter substrate having an array of diodes, preferably Schottky diodes, disposed in the surface thereof opposite the piezoelectric substrate to form an interaction region. Application of a signal uniformly over the interaction region will charge the diodes uniformly and a traveling acoustic wave will interact with the uniformly applied signal to alter the charging pattern of the array in accordance with the acoustic wave amplitude to produce a corresponding altered conductivity pattern in the semiconductor substrate representing the interaction of the uniformly applied signal and the traveling wave signal. A second signal can thereupon be propagated along the piezoelectric substrate to interact with the stored altered conductivity pattern to provide either correlation or convolution operation depending on the direction of propagation thereof along the piezoelectric surface.

14 Claims, 5 Drawing Figures

SURFACE ACOUSTIC WAVE DEVICES FOR PROCESSING AND STORING SIGNALS

The Government has rights in this invention pursuant to Contract No F19628-76-C-0002 (AF) awarded by the Department of the Air Force.

INTRODUCTION

This invention relates generally to surface wave devices for the processing of signals and, more particularly, to the use of diode means, such as Schottky diodes, in connection therewith for providing improved signal processing and storage operations thereof.

BACKGROUND OF THE INVENTION

Signal processing devices have been suggested by the prior art for providing for the processing and storage of signals by utilizing a piezoelectric substrate capable of propagating acoustic wave signals on a selected surface thereof and a semiconductor substrate positioned adjacent and spaced from such surface. Appropriate techniques are utilized for altering the conductivity pattern in the semiconductor substrate in accordance with the wave form of an acoustic wave signal that is propagated along the selected surface of the piezoelectric substrate so that a representation of the acoustic wave signal is effectively and temporarily stored therein. Such techniques for altering the conductivity pattern include applying a signal uniformly over the interaction region which comprises the regions at or near the surfaces of the substrates and the spatial region therebetween so that a second signal which is propagated along the surface of the piezoelectric material interacts with the uniformly applied signal to alter the conductivity pattern in the semiconductor substrate, the altered conductivity pattern representing the stored propagated signal. A further signal subsequently propagated along the piezoelectric substrate surface thereupon interacts with the stored altered conductivity pattern, the interaction thereby producing an output signal at an electrode of the semiconductor substrate which represents the correlation or the convolution of the two interacting signals depending on the direction of propagation of the further signal along the piezoelectric surface. Certain structural embodiments of such technique have been discussed in the articles of Stern and Williamson, "New Adaptive-Signal-Processing Concept" in Electronic Letters, Vol. 10, No. 5, dated Mar. 7, 1974, and of Bers and Cafarella, "Surface State Memory in Surface Acoustoelectric Correlator", Applied Physics Letters, Vol. 25, No. 3, dated Aug. 1, 1974, and in the copending applications, Ser. No. 555,367 of Stern et al., filed on Mar. 5, 1975 and now U.S. Pat. No. 4,016,412, Ser. No. 672,345 of Stern et al., filed on Mar. 31, 1976 and now U.S. Pat. No. 4,075,706, and Ser. No. 672,344 of Stern et al., filed on Mar. 31, 1976.

The major problems with such devices have been that a relatively long time period is required in order to store a signal in the form of such altered stationary conductivity pattern in the previously disclosed embodiments and, once stored, the signal can remain stored therein only for a relatively short time period. In utilizing trap techniques, as disclosed in the above Bers et al. article and the patent applications, for example, the time required to store a signal may be in the order of 0.1 to 1 microseconds ($\mu$ sec.), while the signal can be held in storage only for about 0.1 to 1 milliseconds (msec.), or less. The usefulness of such devices thereby becomes limited because of the relatively long storing or "write" time period and the relatively short storage time period. It is desirable, therefore, to improve such techniques by reducing the write time periods and increasing the storage times.

BRIEF SUMMARY OF THE INVENTION

This invention provides a storage device having extremely fast storing or write times and substantially longer time periods in which signals can remain stored than in the previously disclosed devices discussed in the aforementioned article and copending applications. In accordance therewith, in a preferred embodiment an array of diodes, such as Schottky diodes, are formed in appropriate holes in a thermally grown silicon dioxide layer which is present on a selected surface of a substrate of semiconductor material, such an n-type silicon, and an island, or overlay, comprising a conductive material, for example, a metal such as gold, is formed over each of the diodes of the array to increase the capacitances thereof. An interaction region thereby exists which region includes the regions at or near the adjacent surfaces of the substrates and the spatial region therebetween.

A signal can be applied uniformly over the interaction region to produce time varying properties thereof and providing a substantially uniform charge on each of the diodes.

A surface wave signal which is propagated along the adjacent surface of the piezoelectric substrate thereby interacts with the uniformly applied signal so as to alter the charge placed on the Schottky diodes, which interaction induces further charges proportional to the amplitude of the propagated signal on the diodes so as to alter the uniform charge on the array and thereby to provide an altered stationary conductivity pattern in the semiconductor substrate which represents the wave pattern of the propagated signal.

If a further signal is subsequently propagated along the surface of the piezoelectric substrate, it interacts with the altered stationary conductivity pattern representing the stored signal and provides an output signal at an appropriate electrode of the semiconductor substrate, which output signal represents either the correlation or the convolution of the stored signal with the further signal depending on which direction the further signal is propagated.

A particular embodiment of the invention is discussed in more detail below with the help of the accompanying drawings, wherein FIG. 1 depicts a signal processing device representing an embodiment of the invention;

Figure 1:
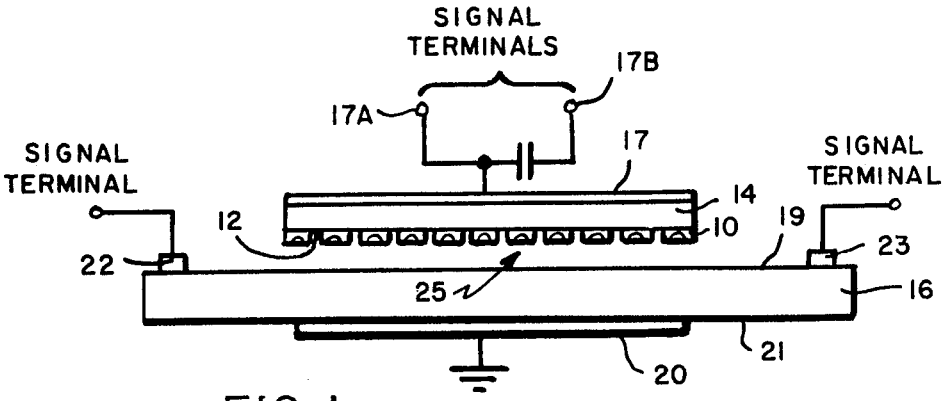
Figure 2:
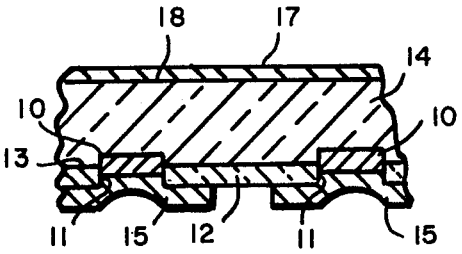
FIG. 2 depicts a more detailed sectional view of a portion of the embodiment of FIG. 1.

FIGS. 1 and 2 depict a preferred embodiment of the invention wherein an array of platinum silicide Schottky diodes 10 are formed in openings 11, each typically from 1 to 5 micrometers in diameter, in a thermally grown silicon dioxide ($SiO_2$) layer 12 formed on a selected surface 13, e.g., the (100) surface, of a substrate 14 of n-type silicon having a surface resistivity, for example, of 30 ohm-centimeters. An island, or overlay, 15 made of a suitable conductive material such as gold is then formed over each diode within said openings and over a portion of the layer 12 in order to increase the electrical capacitance of the diode. The gold may be suitable adhered to the surface 13 by first depositing a thin layer of chromium (not shown) on the exposed substrate surfaces and subsequently depositing the layer of gold thereover.

In a typical embodiment of the invention, for example, the period of the Schottky diode array pattern provides for one diode about every 13 micrometers thereby providing about 2½ diodes per wavelength of an acoustic signal at a center frequency of about 110 MHz. The length of the silicon substrate in a typical embodiment may be about 3.5 centimeters (cm.), corresponding to a transit time of about 10 microseconds. The silicon substrate is placed adjacent the upper surface 19 of the piezoelectric substrate 16 in a manner substantially the same as that described in the above Electronics Letters article of Mar. 7, 1974, with reference to the semiconductor/piezoelectric substrate combination shown therein, an output signal being obtainable at a conductive electrode 17 in the form of a conductive metal layer placed on the opposite surface 18 of the silicon substrate. An interaction region 25 comprising the regions at or near the surfaces 13 and 19 of the spatial region therebetween is thereby present in the overall structure.

In order to store a signal which is propagated along the surface 19 of the piezoelectric substrate 16, the Schottky diodes 10 are forward biased by a very short voltage pulse (in effect an "impulse" signal) applied across the interaction region by applying such signal across the overall structure from a signal terminal 17A of the conductive electrode 17 at the silicon substrate surface 18 to the electrode 20 at the lower conductive surface 21 of the piezoelectric substrate (e.g., a lithium niobate substrate) the application thereof forming a uniform charge on each of the diodes of the array. A surface acoustic wave is propagated so as to travel along the surface 19 of the piezoelectric substrate from a signal input transducer 22 by the application of an electric signal at the signal terminal of transducer 22. The electric fields which are present as a result of the propagation of such surface wave along the piezoelectric substrate will interact with the uniform electric field in the interaction region present because of the uniformly applied signal so as to induce proportional charges on the diodes of the Schottky diode array which charges depend on the amplitude of the surface wave adjacent thereto. The uniform charge which has been placed thereon by the short voltage pulse is thereby altered accordingly.

The overall altered charge pattern thereby accumulated on the diodes will reverse bias the diodes, after the short voltage pulse is removed, and the charge will remain on the diodes for a period of time determined by the time constant thereof, i.e., by the time of the current decay through the reverse biased diodes. During the charging process, the underlying silicon dioxide layer 12 at surface 13 will be depleted to a depth proportional to the overall altered charge thereby forming an altered stationary conductivity pattern in the silicon substrate which represents the wave form of the signal which has been propagated along the surface 19 and which is thereby stored.

Figure 3:
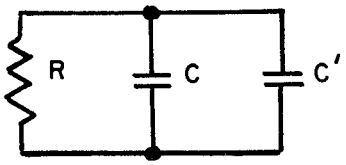
FIG. 3 depicts an equivalent circuit of the device of FIG. 2.

The equivalent circuit of diode/island portions of FIGS. 1 and 2 is shown in FIG. 3, the Schottky diode 10 being electrically equivalent to a circuit having the form of a parallel combination of a resistance R and capacitance C, as shown therein, and the gold island 15 providing an electrical equivalent of an additional capacitance C′, further in parallel therewith. When a signal is to be stored in the silicon substrate, the forward bias signal is applied so as to charge the parallel combination of Schottky diode capacitance C and conductive island capacitance C′. The charging time depends on the forward bias time constant of the circuit which in the embodiment shown can be as fast as 1 nanosecond (1 nsec.). The charge can remain temporarily stored, especially if the Schottky diode is reverse biased for a time period depending on the reverse bias time constant thereof. Upon reverse biasing thereof, the charge can remain in the embodiment shown, for example, for up to 0.1 seconds before being discharged.

Alternatively p.n. diodes can also be used instead of Schottky diodes, the former diodes providing longer charging times and longer storage times.

The forward charging, or "write", time of Schottky diodes of $10^{-9}$ seconds is relatively short as compared to the write times of approximately 0.1 to 1 microseconds of the previously disclosed devices of this general type discussed above. Moreover, the reverse bias "storage" time of Schottky diodes of about 0.1 seconds is relatively long compared to those of the latter devices which, as discussed above, are in the order of 0.1 to 1 milliseconds.

Once the altered stationary conductivity pattern representing a stored signal has been established, a further signal can be applied to the input terminal of transducer 22, for example, which signal as it propagates along the surface 19 of piezoelectric substrate 16 effectively interacts with the stored signal to produce an output signal at the terminal 17B of electrode 17 which is the correlation of the stored signal and the further signal. In a similar manner, a further signal can be applied to the input signal terminal of a transducer 23 at the opposite end of piezoelectric substrate 16 to produce a traveling wave signal which propagates in the opposite direction from a signal applied at transducer 22. Such as oppositely directed traveling wave signal will interact with the stored altered conductivity pattern (i.e., the stored signal) to provide a signal at terminal 17B of electrode 17 which is the convolution of the stored signal with the further signal.

The original stored signal in the process described above is essentially the signal which has been propagated along the surface of the piezoelectric substrate because it has interacted with the very short signal uniformly applied to the device. The uniformly applied signal may be a d-c pulse of very short duration, that is, the time width thereof should be less than $\frac{1}{2}fo$, where $fo$ is the center frequency of the traveling acoustic wave signal propagated along the piezoelectric substrate. Such signal may also be a short a-c pulse, the a-c signal having a frequency $fo$ the same as such center frequency and a time duration which is less than $\frac{1}{2}W_0$, where $W_0$ is the band-width of the traveling acoustic wave signal, as disclosed in the above-mentioned article of Bers et al. and in the above-mentioned copending patent applications.

If the uniformly applied signal is other than a very short pulse signal, that is, a signal having a center frequency $f_1$ and a different bandwidth $W_1$, the stored altered conductivity pattern will represent the convolution of such signal with the traveling acoustic wave signal. In any event a subsequent traveling acoustic wave signal propagated along the piezoelectric substrate will interact with the stored signal and produce a correlation signal or a convolution signal depending on its direction of propagation as discussed above.

Figure 4:
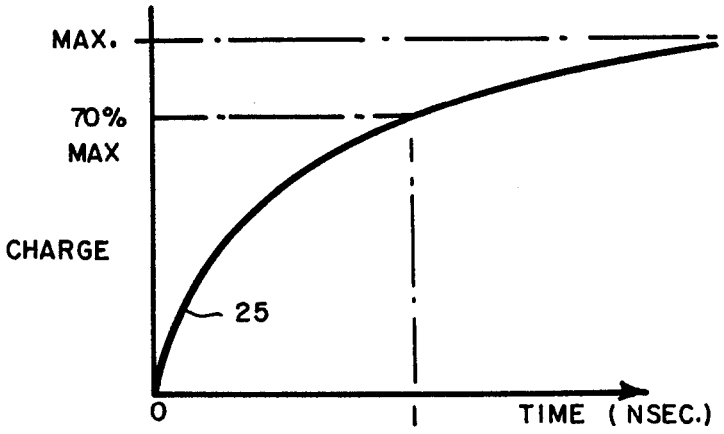
FIG. 4 depicts a graphical representation of the charging curve for the device of FIG. 1.

If it is desired to store a traveling acoustic wave signal, a single uniformly applied pulse signal to the diodes of $10^{-9}$ seconds duration, for example, can be used to produce the stored altered conductivity pattern. Such a signal will effectively charge the diodes so that the maximum charge required on any diode to represent the amplitude of the traveling wave signal will be substantially close to the maximum charge that can be placed on the diode. Thus, as shown by curve 25 in FIG. 4, a diode can reach charge within about 70% of its maximum charge within the 1 nanosecond time duration of the applied signal.

Figure 5:
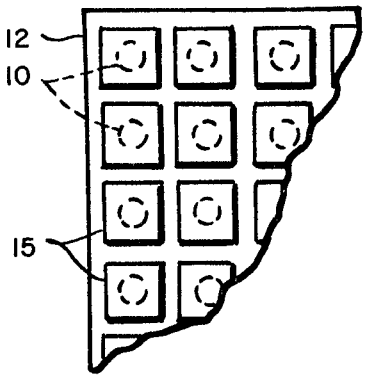
FIG. 5 depicts a plan view of a portion of the device of FIG. 1.

A typical diode arrangement is shown in plan view in FIG. 5, wherein a plurality of square shaped Schottky diodes 10 and islands 15 are placed on silicon dioxide layer 12 in a rectangular array, for example. The array, however, need not be limited to such configuration nor need the diode configurations themselves be so limited for some applications of the device. Further, the diode configuration is not limited to the use of Schottky diodes inasmuch as other diodes, such as p.n. diodes, can also be used within the scope of the invention. Other variations from the specific embodiment shown and discussed herein may occur to those in the art within the scope of the invention and, hence, the invention is not to be construed as limited to the above discussed embodiment except as defined by the appended claims.

What is claimed is:

1. A device for processing and storing signals comprising a first piezoelectric substrate capable of propagating acoustic wave signals on a selected surface thereof;

at least one transducer means formed on said selected surface for generating surface acoustic waves traveling on said surface along a selected direction thereof in response to electrical signals;

a semiconductor material positioned so as to have a first surface thereof, having a selected surface resistivity, adjacent and spaced from said selected surface of said first substrate to form an interaction region which includes the region at or near said surfaces and the spatial region therebetween;

an array of diode elements disposed at said first surface;

a layer of conductive material disposed on a second surface of said semiconductor material, said layer forming an electrode;

means for providing a first signal at said at least one transducer means to produce a first traveling acoustic wave signal along said selected surface of said first subtrate;

means for applying a second signal uniformly over said interaction region to provide time-varying properties thereof for the interaction of said first and second signals thereby producing a spatial charge variation among said diodes, the semiconductor material responding to said spatial charge variation in a manner so as to provide an altered stationary conductivity pattern in said semiconductor material as said acoustic wave signal travels along said selected surface of said first substrate, said altered stationary conductivity pattern being stored in said semiconductor material and representing said interacted first and second signals; and means capable of providing a third signal for interactionwith said altered stationary conductivity pattern, the selected surface resistivity of said semiconductor material being sufficiently high that such interaction can produce a usable interaction output signal.

2. A device in accordance with claim 1 wherein said diodes are Schottky diodes.

3. A device in accordance with claim 2 wherein said semiconductor material is silicon and further including a layer of silicon dioxide, said Schottky diodes being formed in openings in said layer.

4. A device in accordance with claim 3 and further including an island of conductive material disposed over said Schottky diodes and regions of said layer of silicon dioxide adjacent thereto.

5. A device in accordance with claim 4 wherein said conductive material is gold.

6. A device in accordance with claim 5, said gold islands being bonded to said Schottky diodes and said layer of silicon dioxide by a layer of chromium.

7. A device in accordance with claim 2 wherein said third signal is provided at one of said at least one transducer means to produce a second traveling acoustic wave signal along said selected surface of said first substrate after said altered stationary conductivity pattern has been so stored;

said conductive layer disposed on said second surface of said semiconductor material forming an electrode;

whereby the interaction of said second acoustic wave signal with said stored altered stationary conductivity pattern produces said interaction output signal at said electrode.

8. A device in accordance with claim 7 wherein said third signal is provided at the same transducer means as that of said first signal, said second acoustic wave signal traveling in the same direction as said first acoustic wave signal whereby said output signal is a real-time correlation of said third signal with said altered stationary conductivity pattern.

9. A device in accordance with claim 7 wherein said third signal is provided at a different transducer means from that of said first signal for generating an acoustic wave signal traveling in the opposite direction from that of said first acoustic wave signal whereby said output signal is a realtime convolution of said third signal with said altered stationary conductivity pattern.

10. A device in accordance with claim 2 wherein said second signal is a pulse signal having a time duration selected so that said stored altered stationary conductivity pattern represents said first signal.

11. A device in accordance with claim 2 wherein said first signal providing means supplies a pulse signal to one of said at least one transducer means for providing an acoustic signal traveling along said selected surface of said first substrate, the time duration of said pulse signal being selected so that said altered stationary conductivity pattern stored in said semiconductor material represents the wave form of said second signal whereby said second signal is stored in said device.

12. A device in accordance with claim 2 wherein said third signal is provided at said electrode, the interaction of said third signal with said stored altered conductivity pattern producing a second acoustic wave signal traveling along said selected surface of said first substrate to produce said interaction output signal at one of said at least one transducer means.

13. A device in accordance with claim 12 wherein said output signal is produced at the same transducer means as that of said first signal whereby said output signal is a real-time correlation of said third signal with said stored altered stationary conductivity pattern.

14. A device in accordance with claim 12 wherein said output signal is produced at a different transducer from that of said first signal whereby said output signal is a real-time convolution of said third signal with said stored altered stationary conductivity pattern.

* * * * *